US005265938A

United States Patent [19]

Melhuish et al.

[11] Patent Number: 5,265,938

[45] Date of Patent: Nov. 30, 1993

[54] ADJUSTABLE ARM FOR A CHAIR

[75] Inventors: Robert A. Melhuish, East Greenville; Donald A. Wimmer, Upper Hanover, both of Pa.

[73] Assignee: Westinghouse Electric Corp., Pittsburgh, Pa.

[21] Appl. No.: 802,571

[22] Filed: Dec. 5, 1991

[51] Int. Cl.[5] ..... A47C 7/54

[52] U.S. Cl. ..... 297/411.36; 297/411.45

[58] Field of Search ..... 297/411, 412, 416, 417, 297/418–422, 414

[56] References Cited

U.S. PATENT DOCUMENTS

| | | | |
|---|---|---|---|
| 3,489,458 | 1/1970 | Karlsen | 297/417 |
| 4,244,623 | 1/1991 | Hall et al. | 297/411 X |
| 4,311,338 | 1/1982 | Moorhouse | 297/411 |
| 4,489,981 | 12/1984 | Goletski | 297/411 |
| 4,496,190 | 1/1985 | Barley | 297/411 |
| 4,619,478 | 10/1986 | Heimnick et al. | 297/411 X |
| 4,659,135 | 4/1987 | Johnson | 296/453 |
| 4,674,790 | 6/1987 | Johnson | 297/417 X |
| 4,881,424 | 11/1989 | Clark et al. | 297/411 X |
| 4,951,995 | 8/1990 | Teppo et al. | 297/411 |
| 5,009,467 | 4/1991 | McCoy | 297/411 |

*Primary Examiner*—Kenneth J. Dorner
*Assistant Examiner*—Milton Nelson, Jr.
*Attorney, Agent, or Firm*—Carla J. Vrsansky

[57] ABSTRACT

An adjustable arm for a chair and the like whereby the arm may be adjusted vertically within a plurality of incrementally spaced positions. The adjustable arm includes an actuator, a locking lever and a second lever located and mounted between the actuator and the locking lever. The second lever interacts with the actuator and the locking lever and has a pivot point for translating travel of the actuator to travel of the locking lever with ease and a minimum of effort on the part the user. The first lever includes a latch that coacts with predeterminately spaced grooves of a rack, thereby enabling the user to lock the arm into one of various vertical positions, easily and effortlessly.

15 Claims, 8 Drawing Sheets

ADJUSTABLE ARM FOR A CHAIR

BACKGROUND OF THE INVENTION

1. Field of the Invention

This invention relates to an adjustable arm for a chair, and more particularly to an adjustable arm having force reduction means whereby the user may vertically adjust the height of the arm easily and effortlessly.

2. Description of the Related Art

Adjustable arms are widely known in the art and range in application from chairs and office seating to vehicle seating. Office seating typically includes multiple adjustment features in order to adapt to the particular task and the particular user. This seating may include vertical seat height adjustment, back height adjustment and the like. Such office chairs may also include spaced arm rests, which have recently included vertical adjustability.

Means for adjustable arms can be found in the art ranging from telescoping tubes and springs to parallelogram action mechanisms to rack and pawl mechanisms to synchronized, simultaneous adjustment. However, these various means may require the user to expend some effort in adjusting the arm as well as engaging it in a desired position. Also, some means require the user to stand in order to adjust the arm rather than to easily adjust the arm rest while being seated.

Consequently, a need exists for an adjustable arm that can be operated easily and effortlessly by the user while remaining seated, as well as providing a range of vertical adjustment.

SUMMARY OF THE INVENTION

In accordance with the present invention, the foregoing deficiencies of prior art are obviated by providing an adjustable arm for a chair and the like comprising an actuator, a locking mechanism and force reduction means mounted on the arm support. The force reduction means interacts with the actuator and the locking mechanism by having a pivot point for translating travel of the actuator to travel of the locking mechanism. The travel of the actuator is greater than the travel of the locking mechanism.

The arm support carries the arm rest on its top, is surrounded by a housing and includes a plurality of vertical slots. The locking mechanism may be spring urged and pivotally mounted inside the housing and may include two ends, one end of the locking lever being capable of engaging with the vertical slots of the arm support and the other end being capable of interacting with the actuator, which may be mounted on the housing. This interaction of the actuator and the locking lever causes the locking lever to become disengaged from one of the slots in order to reposition the adjustable arm rest relative to the chair.

BRIEF DESCRIPTION OF THE DRAWINGS

While the specification concludes with the claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

The invention herein described provides an adjustable arm for a chair or the like having an actuator, a locking mechanism and force reduction means which enable a user to adjust the arm rest relative to a chair in a plurality of vertical positions easily and effortlessly while remaining seated.

Figure 1:
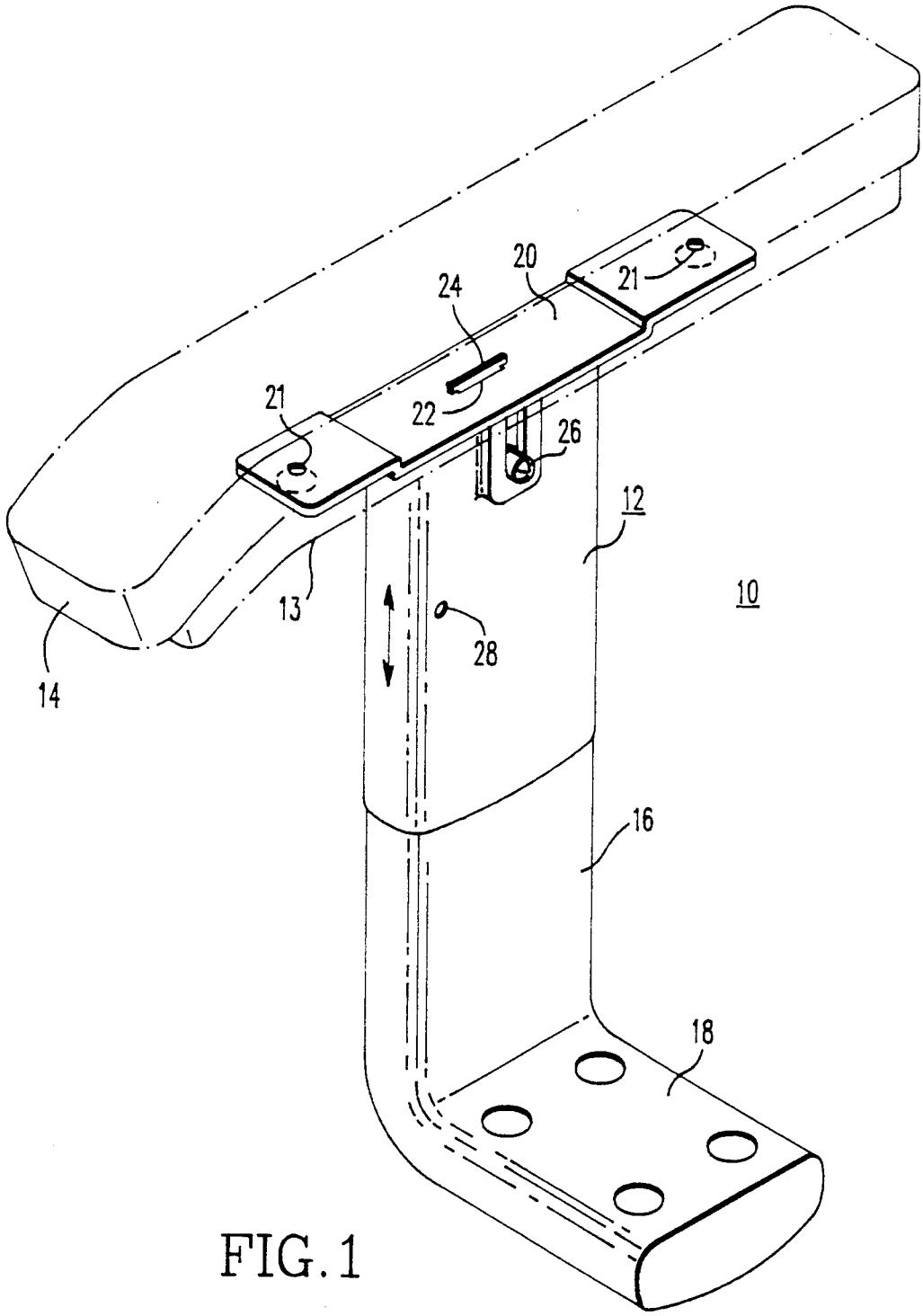
FIG. 1 is an perspective view of an adjustable arm and the means of attachment.

Referring now in detail to the drawings wherein like reference characters represent like parts throughout the several views, there is illustrated in FIG. 1 an adjustable arm 10 which includes a shroud or housing 12, which may be made of metal or plastic. The housing 12 extends upwardly to include an upper portion 13 whereupon an arm rest 14 is attached. The upper portion 13 of the housing 12 and the armrest 14 are shown in phantom for reasons of clarity. An arm support 16 extends downwardly to form a bracket 18 with which to attach the arm 10 to the underside of a chair. The housing 12 surrounds the arm support 16 so as to conceal the inner workings of the adjustable arm 10, which will be described presently, while being able to be moved freely up and down along the arm support 16 by way of a bearing sleeve 17, which is slipped over the arm support 16, as the arm 10 is adjusted to various vertical heights.

Figure 2:
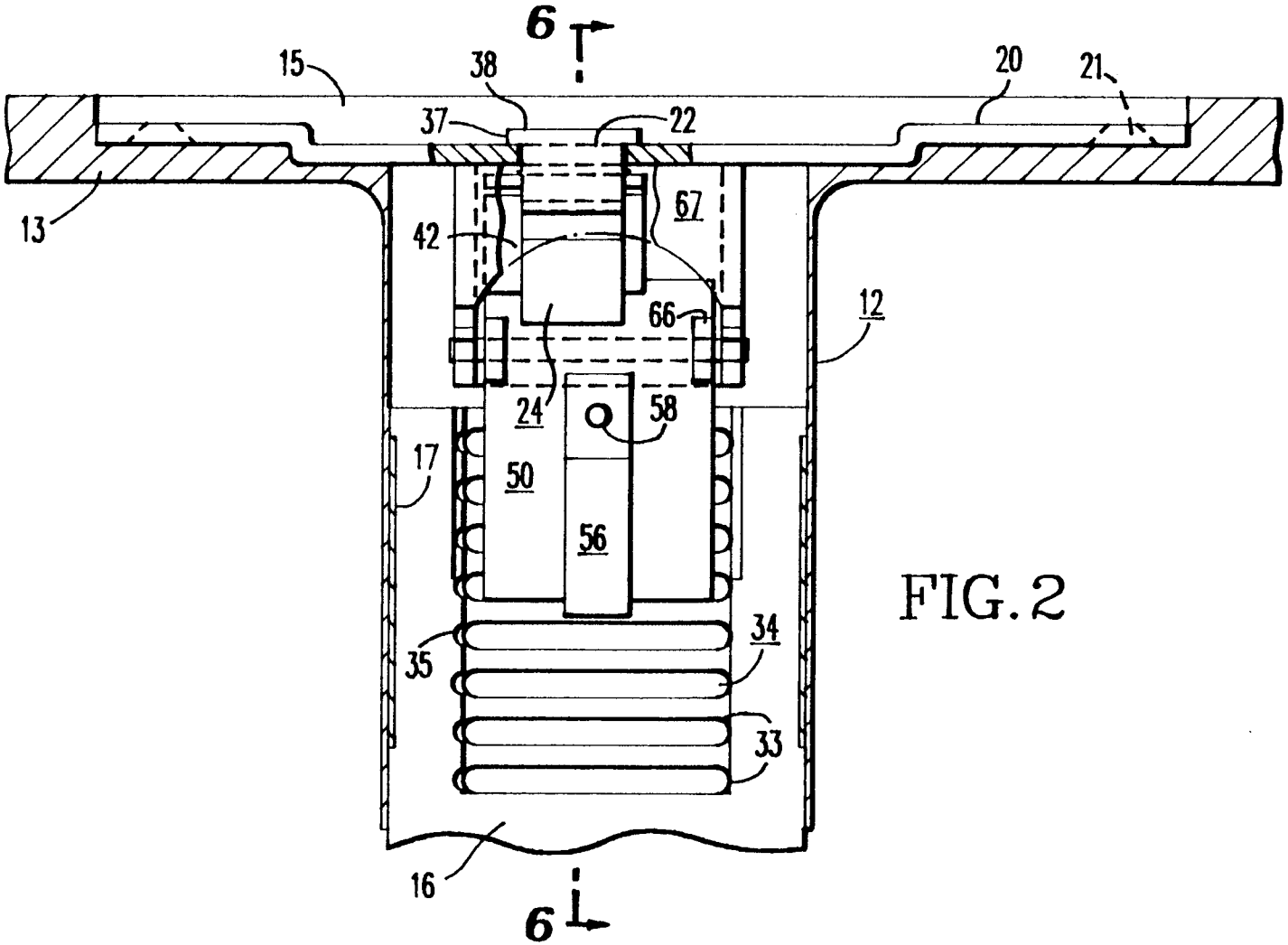
FIG. 2 is a front elevational view of the force reduction means and the locking mechanism engaged in the rack of the adjustable arm.

The upper portion 13 of the housing 12 is hollow and contains a recess 15, which is illustrated in FIG. 2, wherein the inner workings of the adjustable arm 10 are placed. FIG. 1 illustrates a portion of the inner workings contained inside the housing 12. A metal plate 20 is attached to the upper portion 13 of the housing 12 with screws, not shown, which extend through apertures 21. The metal plate 20 includes a slot 22 through which a tongue member 24 extends. The tongue member, or the second lever 24, comprises the force reduction means and will be more fully described presently. An actuator or pushbutton 26 is located on the side of the metal housing 12 and extends through the housing 12. An indicator window 28 may be located on the housing 12 to indicate to the user in which of the various vertical positions the adjustable arm is located.

Figure 3:
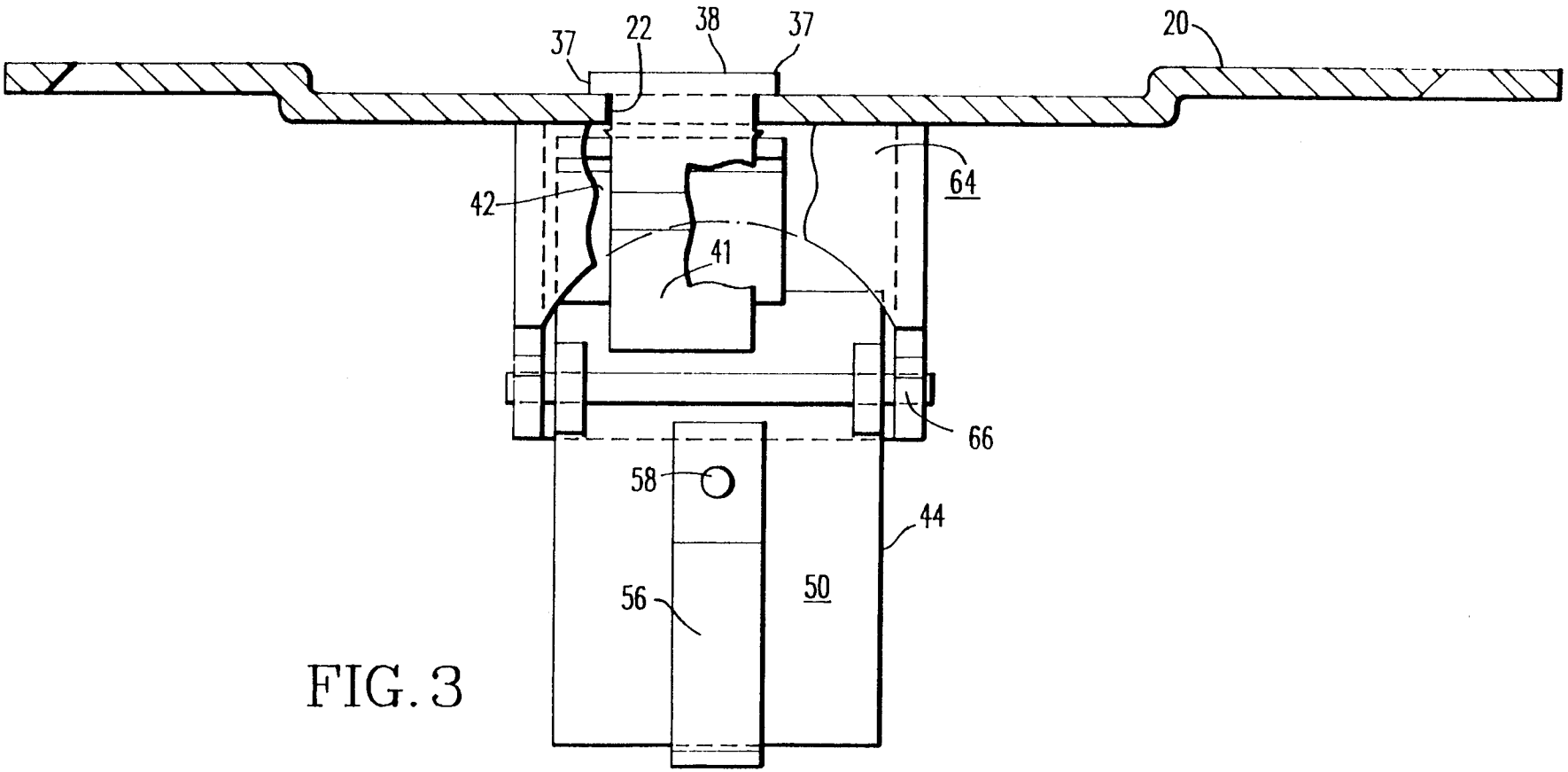
FIG. 3 is front elevational view of the force reduction means and the locking mechanism of the adjustable arm.
Figure 4:
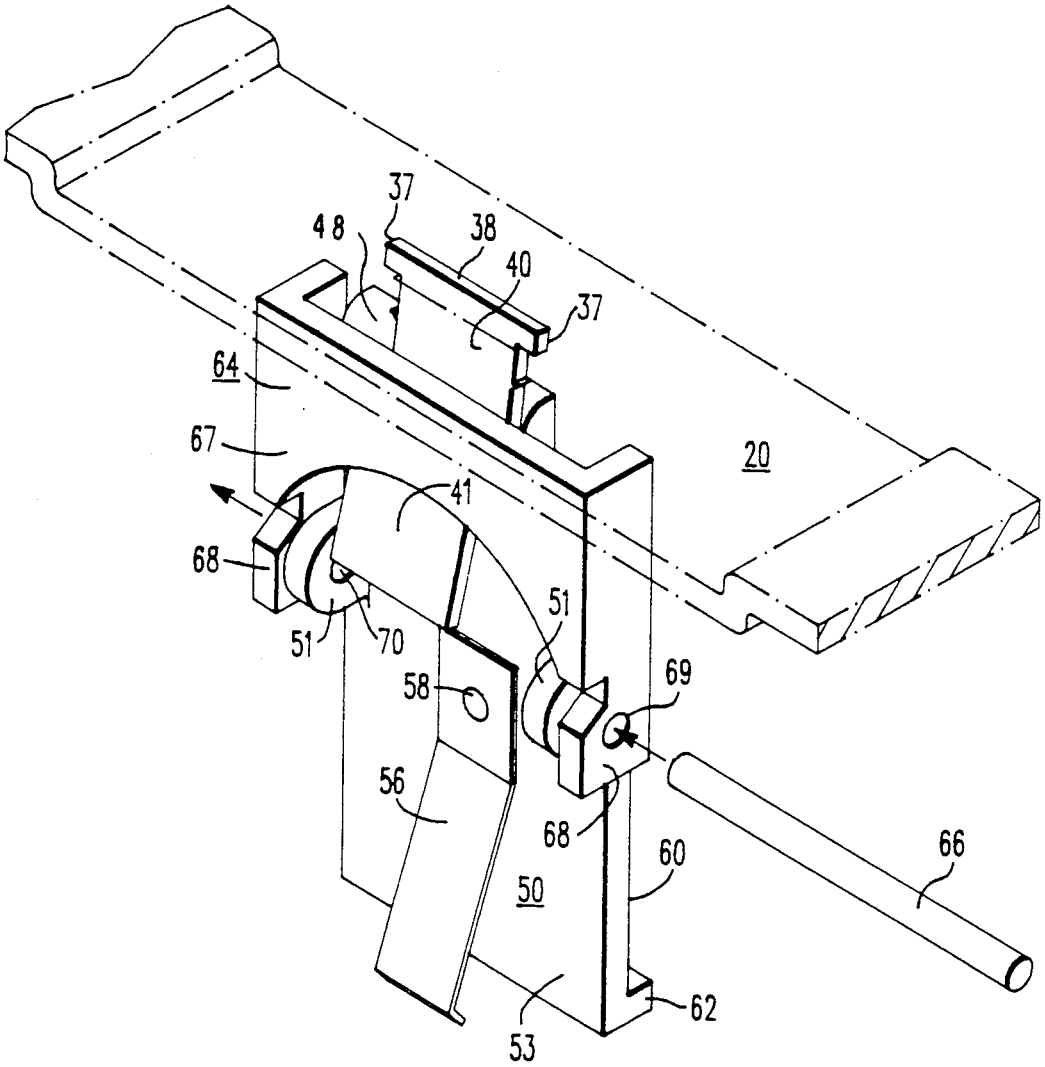
FIG. 4 is a perspective view of the force reduction means and a portion of the locking mechanism of the adjustable arm.
Figure 5:
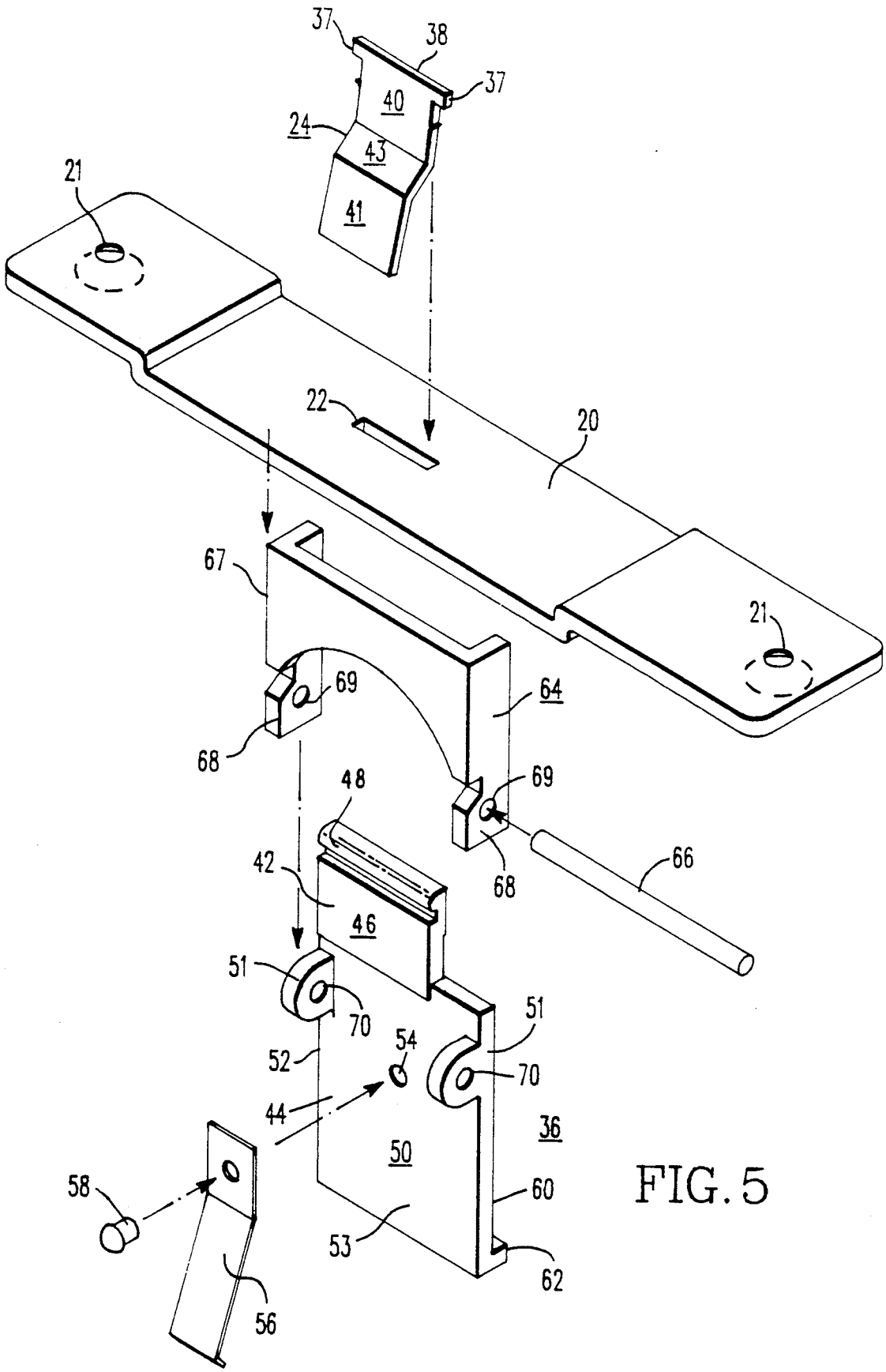
FIG. 5 is an exploded perspective view of the force reduction means and a portion of the locking mechanism of the adjustable arm.

FIG. 2 illustrates a front elevational view with the front of the housing 12 removed in order to expose the inner workings of the adjustable arm 10. The inner workings of the adjustable arm 10 include force reduction means and a locking mechanism. FIGS. 3, 4 and 5 illustrate several views of the force reduction means as well as a portion of the locking mechanism.

FIG. 2 further illustrates the inner workings of the adjustable arm 10 engaged in one of a plurality of grooves 33 of a rack 34. The rack 34 is one of the elements comprising the locking mechanism, which will be described presently, and is contained in the arm support 16 as a means of locating and locking the adjustable arm in one of a plurality of vertical positions. The number of grooves 33 comprising the rack 34 represents the number of vertical positions available in which to adjust the chair arm 10. The rack 34 may also include side grooves 35 which are located perpendicularly to the grooves 33 and serve as a means of producing a "clicking" noise to audibly indicate a change in the positioning of the arm 10 to the user.

The force reduction means, most clearly illustrated in FIG. 5, includes a first lever hereafter referred to as a flipper mechanism 36 and a second lever hereafter referred to as a tongue member 24. The tongue member 24 comprises a metal, T-shaped tab with wing-like extensions 37 along the top 38 of the tongue member 24 and includes a straight portion 40 and an offset portion 41 interconnected by an angled portion 43.

The flipper mechanism 36 includes a first, or top, end 42 and a second, or bottom, end 44. The first end 42 of the flipper mechanism 36 includes a planar portion 46, the top of which forms a ledge 48 that interacts with the straight portion 40 of the tongue member 24. The second end 44 of the flipper mechanism 36 includes a planar portion 50 having two extensions 51 on either side 52. Each extension 51 has an aperture therethrough at 70. The planar portion 50 also includes a front face 53 which contains an opening 54 whereby a leaf spring 56 is secured to the front face 53 by a rivet 58. The back face 60 of the planar portion 50 terminates in an L-shaped ledge or latch member 62 which coacts with the grooves 33 in the rack 34 in order to lock the arm 10 in a desired position.

Still referring to FIG. 5, a C-shaped yoke member 64, which is welded to the bottom of the metal plate 20, extends downwardly and is connected to the flipper mechanism 36 by a hinge pin 66 thereby creating a pivot point on which the flipper mechanism 36 rotates. The yoke member 64 includes a front end 67 which rests against the interior of the front of the housing 12 and two downwardly projecting extensions 68. Each extension 68 contains an aperture 69 which overlaps with the aperture 70 in each of the two extensions 51 of the second end 44 of the flipper mechanism 36. The downwardly projecting extensions 68 of the yoke member 64 fit snugly overtop the side extensions 51 of the flipper mechanism 36 so that the apertures 69 and 70 are aligned to receive the hinge pin 66 thereby connecting the yoke member 66 to the flipper mechanism 36 and creating a pivot point on which the second end 44 of the flipper mechanism 36 rotates.

Figure 8:
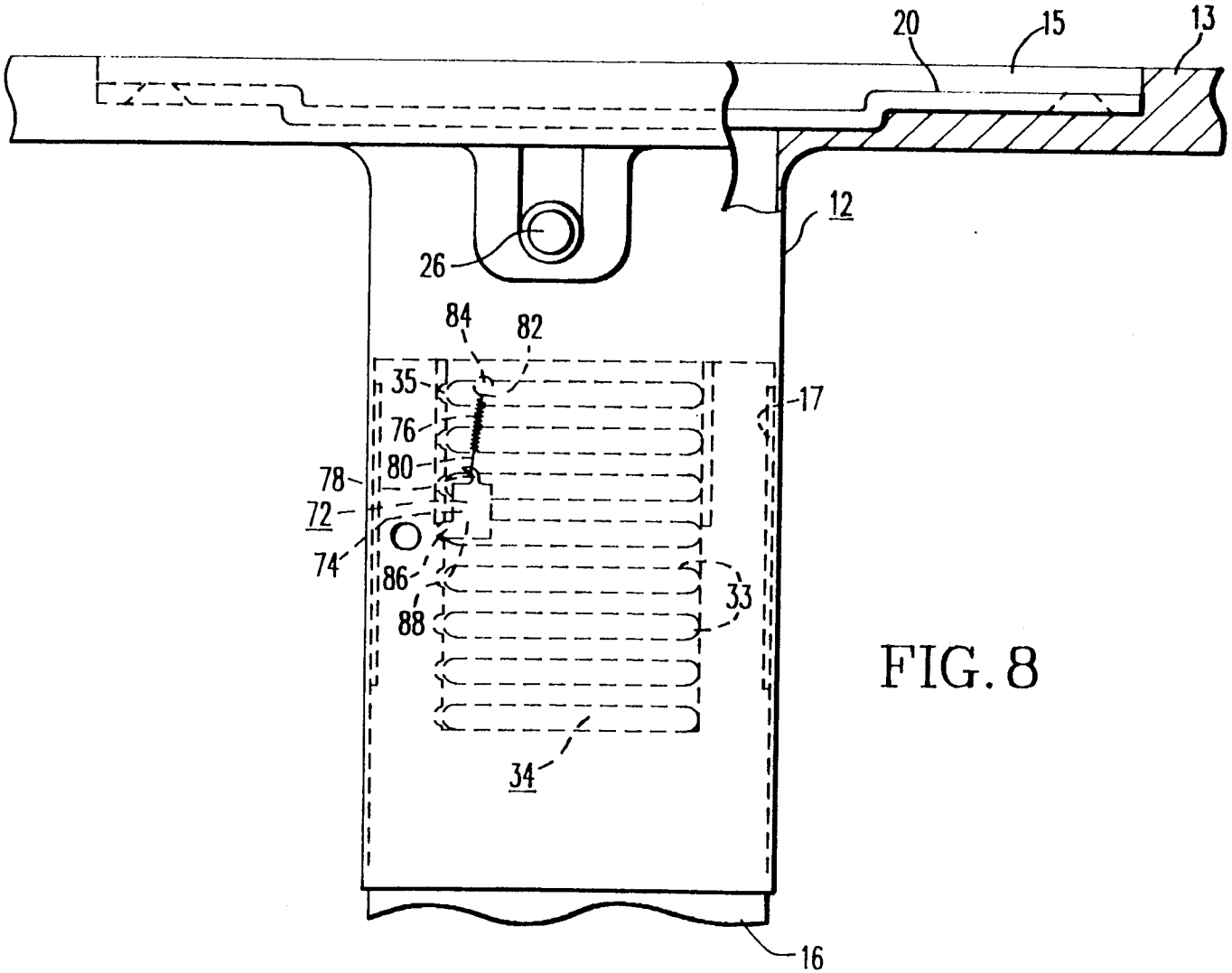
FIG. 8 is a front elevational view of the adjustable arm housing with a cut-away view of the rack and the indexer of the adjustable arm.
Figure 9:
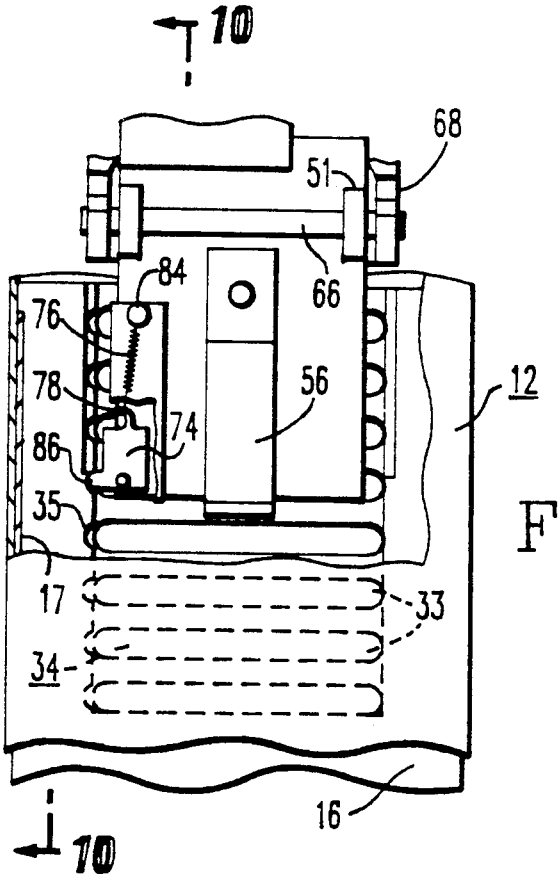
FIG. 9 is a front elevational view of the locking mechanism of the adjustable arm including the indexer.
Figure 10:
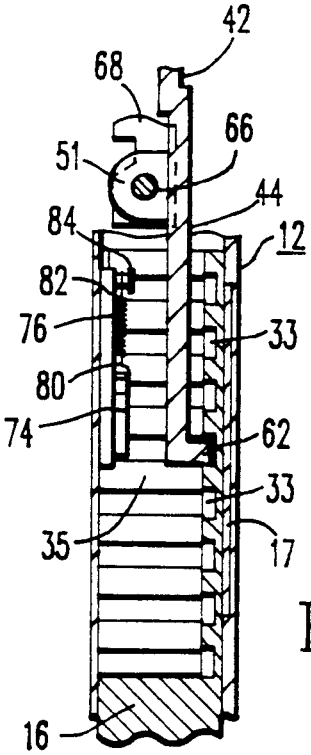
FIG. 10 is a sectional view of the indexer of the adjustable arm taken along the line 10—10 of FIG. 9.

FIGS. 8, 9, and 10 illustrate several views of an indexer 72 which may be located on the inside of the front of the housing 12 and includes a cam 74 and spring 76. The cam 74 is mounted for rotation about a pin 75 which may be mounted to the inside of the front of the housing 12 and includes a hook-like projection 78 by which one end 80 of the spring 76 is attached. The other end 82 of the spring 76 is attached to the inside of the housing 12 by a small rivet 84. The cam 74 further includes a tooth 86 which extends from one side near the bottom 88 of the cam 74 and interacts with the side grooves 35 of the rack 34 to produce a "clicking" noise to audibly indicate a change in position of the arm rest 14 as the housing 12 is moved upwardly or downwardly along the arm support 16.

Each element and its cooperation relative to each other will now be described in order to understand the operation of the adjustable arm. The tongue member 24 is inserted into the slot 22 in the metal plate 20 and extends downwardly. The wing-like extensions 37 located along the top 38 of the tongue member 24 hold the tongue member 24 in place and define a pivot point for the tongue member 24 which swings freely but does not fall through the slot 22. The straight portion 40 of the tongue member 24 coacts with the first end 42 of the flipper mechanism 36 in such a way that the ledge 48 abuts the straight portion 40 of the tongue member 24. The offset portion 41 of the tongue member 24 is disposed adjacent the conical tip of the pushbutton 26.

Figure 6:
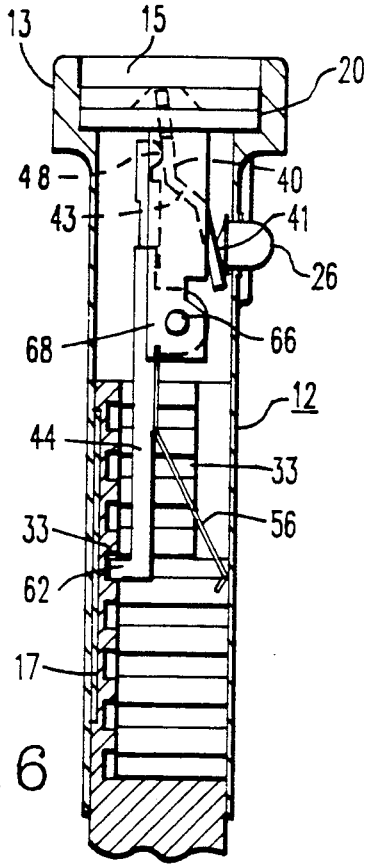
FIG. 6 is sectional view of adjustable arm taken along the line 6—6 of FIG. 2.
Figure 7:
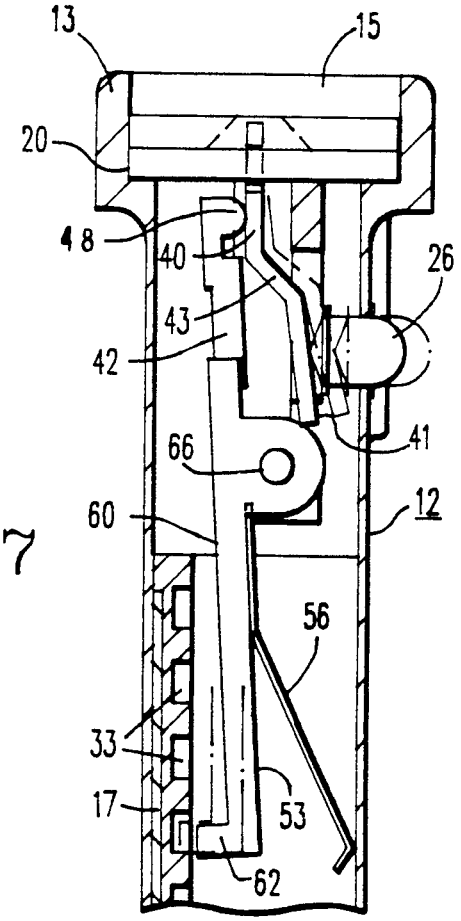
FIG. 7 is an enlargement of the sectional view of the adjustable arm taken along the line 6—6 of FIG. 2 illustrating the operation of the adjustable arm.

FIGS. 6 and 7 best illustrate the actual operation of the adjustable arm 10. The user depresses the pushbutton 26 which moves the offset portion 41 of the tongue member 24 a predetermined distance. The pushbutton 26 has a conically shaped tip for constant concentrated contact with the tongue member 24. This actuation of the pushbutton 26 and the tongue member 24 causes the tongue member 24 to act against the first end 42 of the flipper mechanism 36 with a force that has been enhanced by the differences in the distance from the tongue member 24 pivot point. This force pivots the second end 44 of the flipper mechanism against the leaf spring 56 which is restrained by the interior of the front of the housing 12. This movement causes the latch member 62 located at the back face 60 of the second end 44 of the flipper mechanism 36 to become disengaged from one of the plurality of grooves 33 of the rack 34 thereby enabling the arm rest 14 and the associated housing 12 to be adjusted vertically to another desired position easily and effortlessly by way of the bearing sleeve 17, which by its construction, produces a low coefficient of friction, thereby obviating the need for ball bearings and the like. Once the desired position is reached, as can be evidenced by the "clicking" noise of the indexer 72 tooth 86 grating along the side grooves 35 of the rack 34, the user releases the pushbutton 26. This results in the urging back of the latch member 62 into a new groove 33 of the rack 34 by the leaf spring 56. Thus, the arm is locked into a new vertical position and remains stationary until a different vertical position is desired.

A user can vertically adjust the arm rest of the chair while seated by gripping the arm rest and depressing the pushbutton with his or her thumb. This depressing of the pushbutton is the only effort that need be expended by the user. The force reduction means which includes the tongue member and the first end of the flipper mechanism translates the small force expended by the user into a greater force which causes the latch member to become disengaged from the rack, thereby enabling the user to easily move the arm rest and associated housing upwardly or downwardly to a different position. Thus, the invention provides for a means of adjusting an arm rest easily and effortlessly by a user while remaining seated.

We claim:

1. An adjustable arm comprising:

an armpad having a plate on which said armpad is attached;

an actuator mounted on said arm for adjusting the location of said armpad;

a locking mechanism comprising a first lever having a first end and a second end and a yoke member attached to said plate of said armpad for locking said armpad in a plurality of vertical positions, said first lever being pivotally mounted to said yoke member; and force reduction means comprising a second, T-shaped lever pivotally suspended from said plate of said armpad and interposed between said actuator and said first end of said first lever, said force reduction means interacting with said actuator and said first lever for adjusting the height of said armpad.

2. The adjustable arm according to claim 1 wherein said actuator comprises a pushbutton mounted on said arm for adjusting the position of said arm.

3. The adjustable arm according to claim 2 wherein said pushbutton includes a conically shaped tip that directly interacts with said second lever of said force reduction means thereby causing said second lever of said force reduction means to interact with said first end of said first lever of said locking mechanism.

4. The adjustable arm according to claim 3 wherein said locking mechanism further comprises a rack including a plurality of grooves contained on said arm.

5. The adjustable arm according to claim 4 wherein said second end of said first lever includes a latch member selectively receivable by one of said plurality of said grooves of said rack.

6. The adjustable arm according to claim 5 wherein said locking mechanism includes a leaf spring attached to said second end of said first lever, said leaf spring urging said latch member into a selected groove.

7. The adjustable arm according to claim 4 wherein said rack further includes side grooves adapted to receive an indexer.

8. The adjustable arm according to claim 7 wherein an indexer having a cam and spring mechanism is associated with said locking mechanism, said cam including at least one tooth thereon for interacting with said side grooves of said rack.

9. A selectively positionable arm rest for a chair comprising:

an arm support member having a plurality of horizontally disposed vertically oriented grooves therein;

a slidably mounted, cylindrical housing surrounding said support member and carrying said arm rest at the upper end thereof;

a locking mechanism including a pivotally mounted, spring urged mounted internally of said housing, said locking lever including a first end and a second end, said second end having a latch member thereon for engaging with one of said slots of said support member; and actuator means mounted on said housing and interacting with said first end of said locking lever whereby actuation of said actuator means causes said locking mechanism to disengage from one of said slots for selective repositioning of said arm rest relative to said chair.

10. The arm rest according to claim 9 wherein said locking lever is pivotally mounted within said housing intermediate said first and second ends.

11. The arm rest according to claim 10 wherein a second lever is interposed between said actuator means and the first end of said locking lever whereby actuation of said actuator means causes said second lever to move said first end of said locking lever thereby removing said latch member from said slot.

12. The arm rest according to claim 11 wherein movement means is associated with said locking mechanism, said movement indicator means including a spring urged tooth on said housing which coacts with a set of slots said arm support to provide an audible indicia of movement of said adjustable arm.

13. A selectively positionable arm rest for a chair comprising:

an arm support member having a plurality of horizontally disposed vertically oriented slots therein;

a housing surrounding said support member and carrying said arm rest at the upper end thereof;

a locking mechanism comprising a pivotally mounted, spring urged locking lever mounted internally of said housing, said locking lever including a first end and a second end, said second end having a latch member thereon for engaging with one of said slots of said support member;

actuator means mounted on said housing; and a second lever interposed between said actuator means and said first end of said locking lever whereby actuation of said actuator means causes said second lever to interact with and move said first end of said locking lever thereby causing said latch member to become disengaged from one of said slots for selective repositioning of said arm rest relative to said chair.

14. The arm rest according to claim 13 wherein movement indicator means is associated with said locking mechanism, said movement indicator means including a spring urged tooth on said housing which coacts with a set of slots on said arm support to provide an audible indicia of movement of said adjustable arm.

15. An adjustable arm comprising:

an actuator mounted on said arm for adjusting the location of said arm;

a locking mechanism comprising a lever having a first end and a second end and a yoke member which is mounted to said arm, said lever being pivotally mounted to said yoke member;

force reduction means mounted on said arm and interacting with said actuator and said first end of said locking mechanism, said force reduction means having a pivot for translating travel of the actuator to travel of the locking mechanism whereby the distance traveled by the actuator is greater than the distance traveled by the locking mechanism;

a rack mounted on said arm including a plurality of first grooves and a plurality of side grooves arranged perpendicularly to said first grooves, said first grooves adapted to receive said second end of said locking mechanism; and an indexer having a cam and spring mechanism, said cam including at least one tooth thereon for engagement with said side grooves of said rack.

* * * * *